United States Patent [19]

McIntosh

[11] Patent Number: 4,776,284

[45] Date of Patent: Oct. 11, 1988

[54] RETRACTABLE WORK STATION

[75] Inventor: Lawrie McIntosh, Etobicoke, Canada

[73] Assignee: Kosuth Inc., Kitchener, Canada

[21] Appl. No.: 20,974

[22] Filed: Mar. 2, 1987

[30] Foreign Application Priority Data

Aug. 26, 1986 [CA] Canada ..... 5168597

[51] Int. Cl.[4] ..... A47B 21/03

[52] U.S. Cl. ..... 108/138; 248/1 B; 248/281.1; 312/208; 312/325

[58] Field of Search ..... 248/1 B, 425, 585, 284, 248/281.1; 312/208, 24, 27, 325, 248; 108/138

[56] References Cited

U.S. PATENT DOCUMENTS

| | | | |
|---|---|---|---|
| 876,159 | 1/1908 | Erickson | 312/248 |
| 883,305 | 3/1908 | Fetch | 312/325 X |
| 1,565,246 | 12/1925 | Axen | 312/27 |
| 2,822,229 | 2/1958 | Carlson | 248/284 X |
| 2,874,994 | 2/1959 | Chester | 248/284 X |
| 3,474,991 | 10/1969 | Toubhans | 248/284 X |
| 4,625,657 | 12/1986 | Little et al. | 108/138 X |
| 4,644,875 | 2/1987 | Watt | 108/138 X |
| 4,691,888 | 9/1987 | Cotterill | 248/1 X |

FOREIGN PATENT DOCUMENTS

| | | | |
|---|---|---|---|
| 2518942 | 11/1976 | Fed. Rep. of Germany | 312/208 |
| 3433137 | 3/1986 | Fed. Rep. of Germany | 108/138 |
| 799674 | 6/1936 | France | 312/208 |
| 255365 | 6/1948 | Switzerland | 312/27 |

*Primary Examiner*—Peter A. Aschenbrenner
*Assistant Examiner*—James R. Brittain
*Attorney, Agent, or Firm*—Patrick J. Hofbauer

[57] ABSTRACT

A retractable work station suitable for use with a computer keyboard has a parallel swing-link suspension for selectively moving a working platform surface from a fully retracted position, to an advanced working position, while maintaining unchanged the inclination of the platform surface. The apparatus is equipped with a brake for immobilizing the linkage in any desired intermediate position. The platform is adjustably secured to a moveable frame portion of the apparatus so that the inclination of the work platform can be selectively adjusted. One embodiment incorporates tension springs to urge the platform towards either one or the other of its bi-stable positions i.e. fully retracted or fully extended. An inverted embodiment of the apparatus maintains itself in a selected one of its two bi-stable positions without the need for springs. The shape of the respective links of the suspension assures the maintenance of an adequate free space over the platform when retracted, for storage of a keyboard apparatus thereon.

5 Claims, 6 Drawing Sheets

RETRACTABLE WORK STATION

This invention is directed to a suspension system for attachment to a desk or other support structure, and, more particularly, to a suspension system for a retractable work station for use with, for example, a typewriter or computer keyboard.

The utilization of a computer system within an office environment can be greatly enhanced if the accessed elements, particularly the keyboard, are made readily accessible upon demand, and can yet be stored in a retracted condition to free work space for other activities, and/or withdraw the keyboard to a less exposed locale when it is not in use.

One known arrangement relies upon a generally linear fixed track having a carriage slideably mounted thereon so as to provide a desired range of advancement or retraction, and a pivoted arm extending from the carriage to provide components of elevation and inclination position variation, for a working platform secured to the arm.

The present invention provides a retractable work station having a pivotably retractable work platform mounted by a link suspension system so as to provide horizontal and vertical displacement simultaneously, while maintaining a constant attitude of a working platform of the work station.

The subject system further provides a bi-stable spring loaded system wherein the suspension link mechanism pivots the working platform from a first, retracted position wherein the platform is held in a first restrained position, to a second, fully advanced position wherein the suspension link mechanism is again secured in restrained relation.

The invention further provides brake means for releasably securing the working platform in any position, including positions intermediate the aforementioned advanced and retracted positions.

The invention further provides a suspension link mechanism having one or more pairs of links each link being cranked intermediate the ends thereof, having the cranked portions in back-to-back relation so as to maintain a predetermined clearance space above the working platform, for storage of a keyboard thereon then in a retracted position.

The invention further provides adjustable attachment means connecting the working platform to a moveable frame portion, which frame portion interconnects the individual lever members of the supporting link system. The adjustable attachment means permits pivotal adjustment of the inclination of the working surface of the working platform.

A further emobidment provides a bi-stable system wherein the self weight of the working platform and its load is relied upon to secure it in the working and in the retracted biasing position, without springs, gas cylinders or other similar biasing devices.

Thus there is provided a manually repositionable work station apparatus having at least two degrees of freedom of movement, comprising a mounting frame; at least one pair of links having two links of substantially equal effective length pivotably secured in spaced apart relation to the mounting frame and to a moveable frame portion of the apparatus having a working platform secured thereto, to provide a predetermined range of displacement of the work station from a fully extended working position to a fully stowed position while maintaining the attitude thereof substantially constant.

There is further provided an adjustable brake means for selectively securing at least one link in non-moving relation relative to one or other of the frame members so as to substantially immobilize the moveable frame position relative to the mounting frame.

Two embodiments of the invention are described below by way of example only, with reference being made to the accompanying drawings, wherein.

Figure 1:
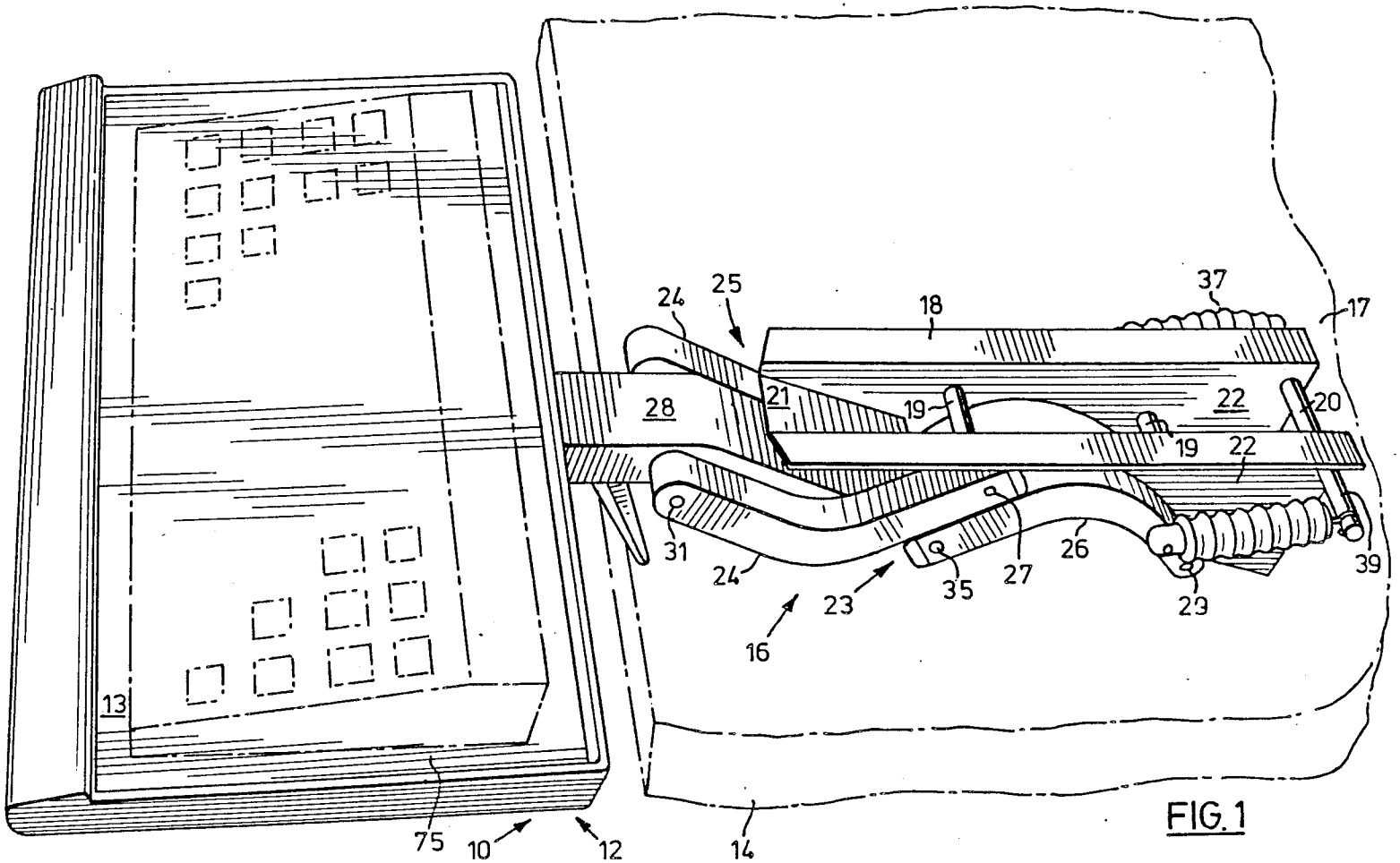
FIG. 1 is a perspective view from above of a preferred embodiment of the subject work station having the support system therefor in an extended position, relative to an adjacent support structure.

Referring to FIG. 1, the subject work station apparatus 10 has a platform 12 supported from beneath a support member 14 such as a portion of a table or desk, as shown in phantom. A bi-stable retraction/extension mechanism 16 is secured by flanges 18, 20 to the undersurface of member 14, by means of screws (not shown). A fixed mounting frame 17, of which flanges 18, 20 form a part, has parallel side plates 22 in spaced apart relation having spacers 19 and an inclined plate end portion 21 extending therebetween. A pair of link sets 23, 25 are located, one on each side of the mounting frame 17, each link set comprising a forward elbow link 24 and a rearward elbow link 26 pivotally secured at 27, 29 respectively. A moveable frame portion 28 of the apparatus 10 has the links 24, 26 pivotally secured thereto at 31 and 35, respectively.

In FIG. 1 the platform portion 12 is in a fully forward working position, having illustrated thereon in phantom a typical keyboard of a computer, mounted upon rubber pad 13 of the electrically grounded type. The upper surface 75 of the rubber pad 13 constitutes a work surface 75 for the user.

Figure 2:
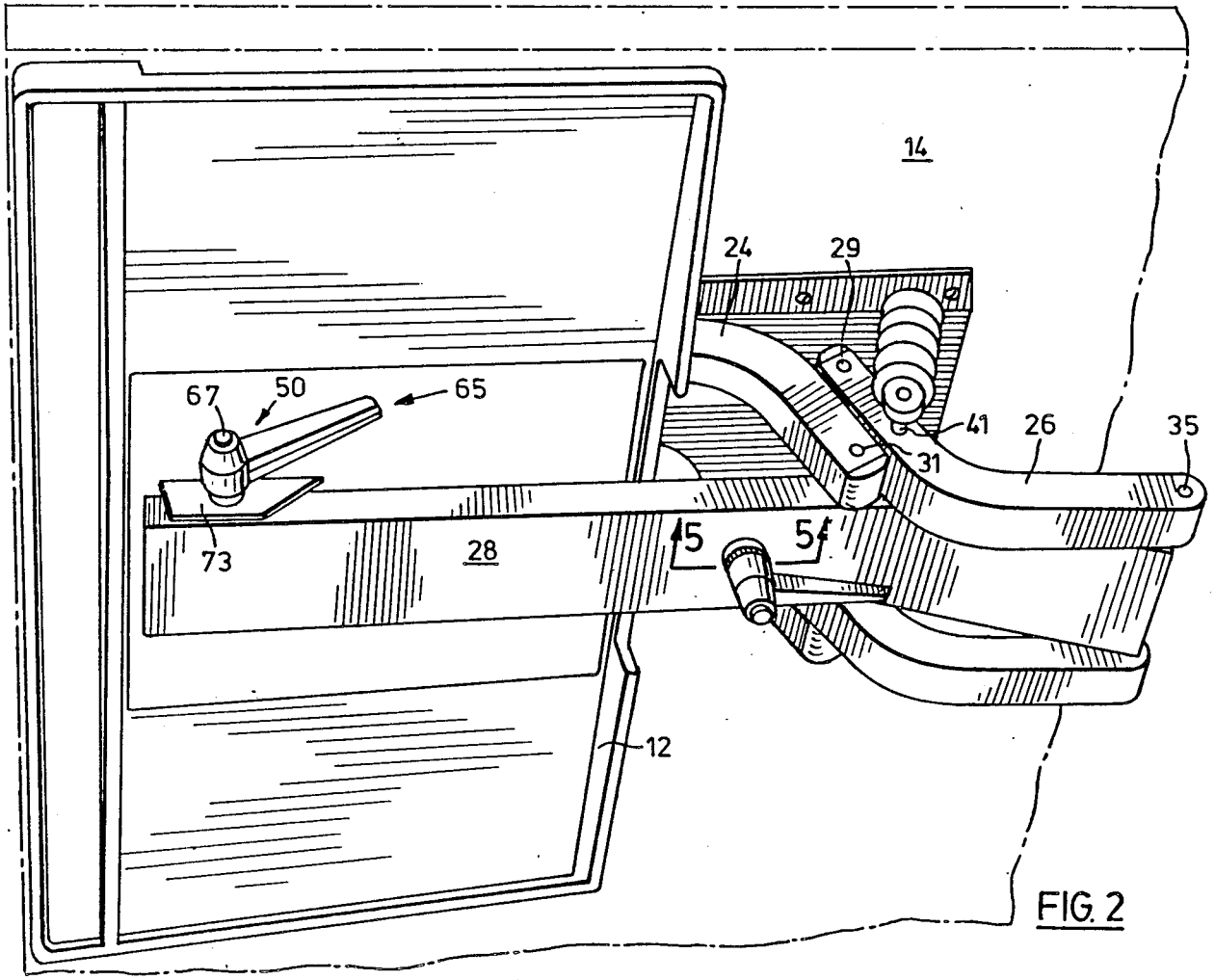
FIG. 2 is a perspective view from beneath, showing the arrangement of FIG. 1 in a fully retracted position beneath the support structure.

Referring to FIG. 2, the platform portion 12 is shown in a fully retracted stowed position by reverse pivoting of the elbow links 24, 26. Being of equal effective length, the links 24, 26 maintain the moveable frame portion 28 in a generally constant orientation for all positions. In the advanced position of FIG. 1 and the retracted position of FIG. 2, the elbow links 24, 26 are positioned in overlapping abutting relation, being held tightly pressed together by a pair of coil springs 79 (see FIG. 3) enclosed within protective rubber sleeves 37. The location of the cranked elbow links 24, 26 in back-to-back relation (see FIG. 6) ensures the preservation of a clear stowage space for a keyboard upon the platform 12 when in the fully retracted, stowed condition.

The springs 79 are carried by transverse bar 39 which extends through the side plates 22 of frame 17. The remote ends of springs 79 are pivoted to the link 26 by way of stub arms 41 extending transversely from the rearward links 26.

Figure 3:
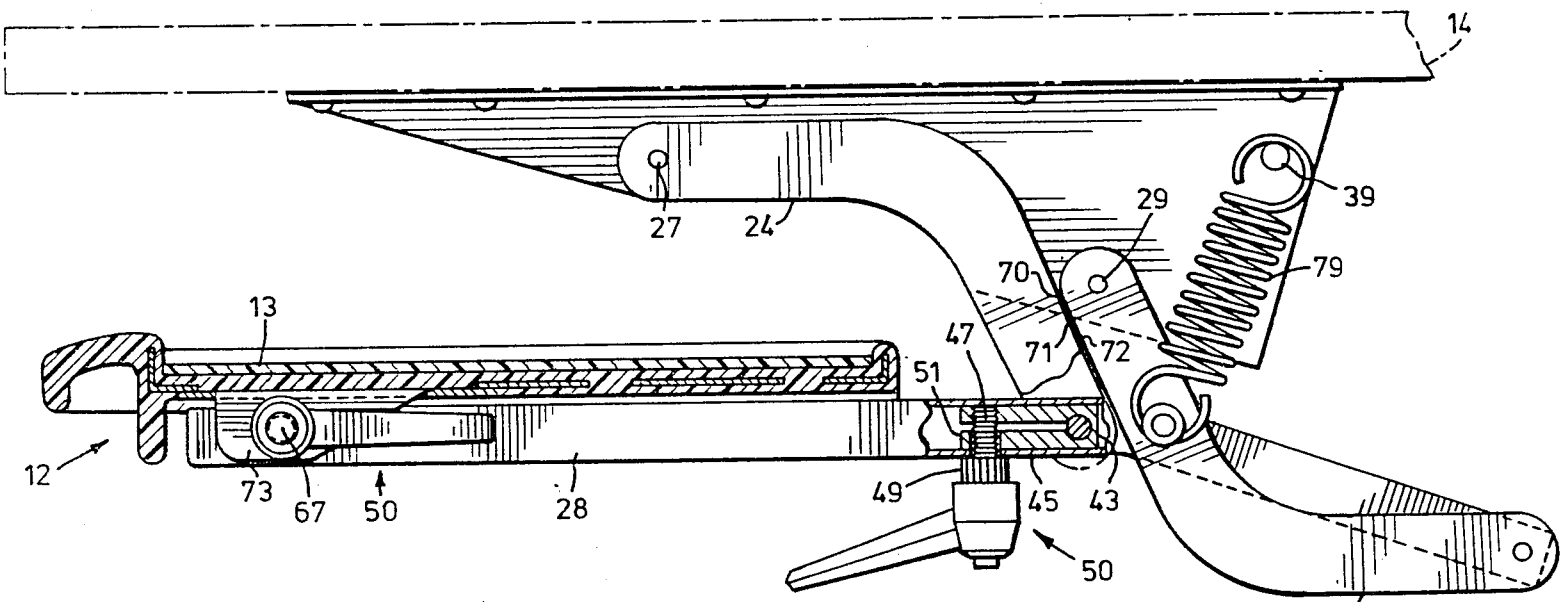
FIG. 3 is a side elevation, in partial section, of the support system arrangement of FIG. 2.

Referring to FIGS. 1, 2 and 3 it will be seen that the geometry of the arrangement is such that the stub arms 41 traverse the axis defined by bar 39 and pivot point 29, about which elbow link 26 rotates. Thus in the fully extended working position of work station apparatus 10, shown in FIG. 1, the springs 79 are positioned above pivot point 29, whereas in FIGS. 2 and 3 the axis of springs 79 is positioned below the pivot point 29, having traversed the axis extending between bar 39 and pivot point 29. This overcentre relationship provides a bi-stable characteristic to the apparatus, the springs 79 tending to move the work platform 12 to one or other of its terminal positions, except in the unstable dead centre position.

Referring to FIGS. 2 and 3, in regard to the adjustable brake means, the moveable frame portion 28 is of hollow section, having a pivot pin 43 extending transversely therethrough. The ends of pivot pin 43 are immovably secured at 31 to the forward links 24. Any displacement of the linkage, to move platform 12, creates relative rotation between pivot pin 43 and frame portion 28.

A bifurcated brake block 45 straddles the pivot pin 43, having a threaded screw 47 and nut portion 49 in selectively compressing relation with the legs 51 of block 45. Thus tightening of the screw 47 compresses brake block 45 in gripping relation about pivot pin 43, to preclude relative rotation therebetween, so as to lock the platform 12 in its instantaneous position, despite the turning force exerted by the springs 79 acting upon the link mechanism, or the load normally carried by the platform 12.

In the retracted position shown in FIGS. 2 and 3 it will be seen that a predetermined minimum working clearance sufficient for placement of a keyboard exists at all times above platform 12, so that the keyboard need not be removed in the fully retracted position. A thin foam pad 70 (see FIG. 3), is preferably provided on either one of the contacting surfaces 71, 72 of the links 24, 26 to soften such contact and to form, together with the contacting surfaces 71, 72 abutment means to preclude movement of the platform 12 in a manner to reduce the working clearance to a value less than said minimum value.

Figure 4:
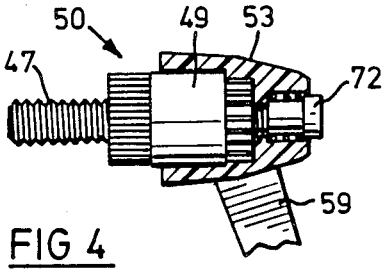
FIG. 4 is a detailed diametrical cross-section of one of the adjustable torque arms shown in FIGS. 2 and 3.
Figure 5:
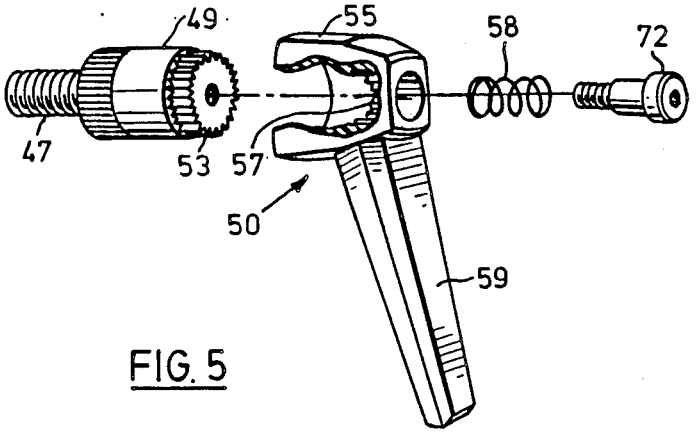
FIG. 5 is a perspective view, in partial section, of the torque arm of FIG. 4, in exploded relation.

Referring to FIGS. 3 through 5, each of the two control locking devices 50 comprise a threaded bolt portion 47, a head portion 49 having axially extending splines 53 at the outer end thereof. A driving cap 55 has internal splines 57 mating with the splines 53, and a torque arm 59, for manually tightening or slackening the bolt portion 47. A coil spring 58 and cap screw 72 retain driving cap 55 in secured relation to the bolt head portion 49, the spring 58 permitting manual repositioning by axial displacement of the cap 55, to disengage splines 57 from the mating splines 53 of the bolt head 49. This permits independent angular rotational repositioning of the torque arm 59 for convenience of the user, without effecting any change to the torsion exerted by bolt portion 47. The above described adjustable torque arm arrangement is a proprietary handle arrangement known as the "ELESA" (trade mark) handle.

A platform tilt control means 65 comprises a pivot pin 67 pivotally connecting a frame portion 73 of platform 12 to the moveable frame portion 29. The adjustable control locking device 50 operates to tension the carriage bolt 69 and lock the members frictionally in secured relation. This affords a range of angular inclination of up to about 12 degrees to the working surface 75 of the platform 12.

Figure 6:
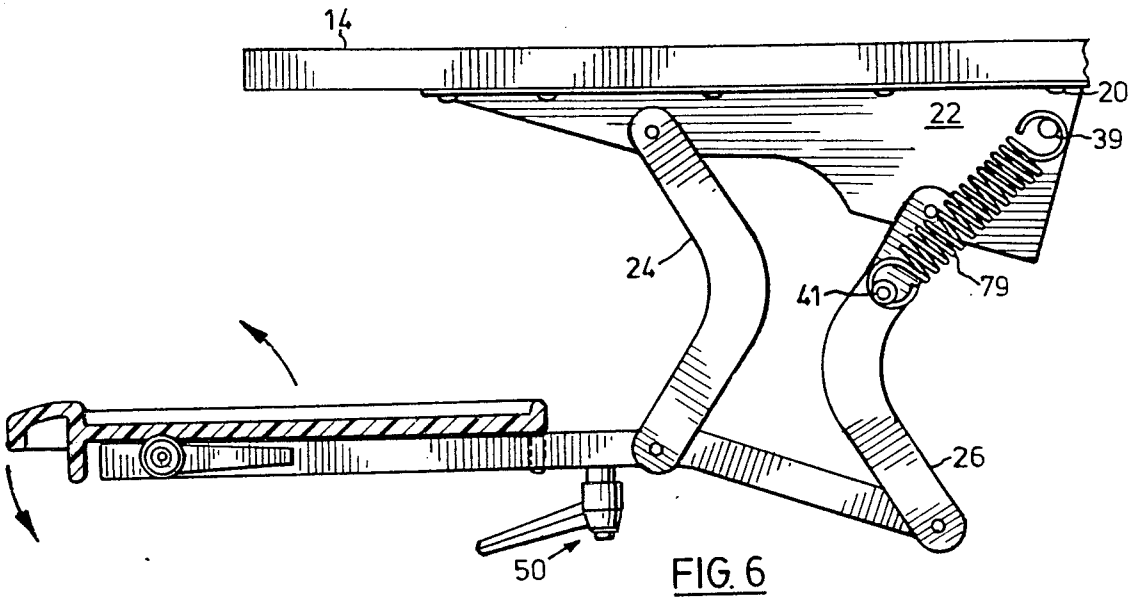
FIG. 6 is a side elevational view, showing the suspension portion of the system locked in an intermediate position.

FIG. 6 shows the platform 12 locked in an intermediate position, the springs 35 being just off the aligned neutral position (which is unstable).

Figure 7:
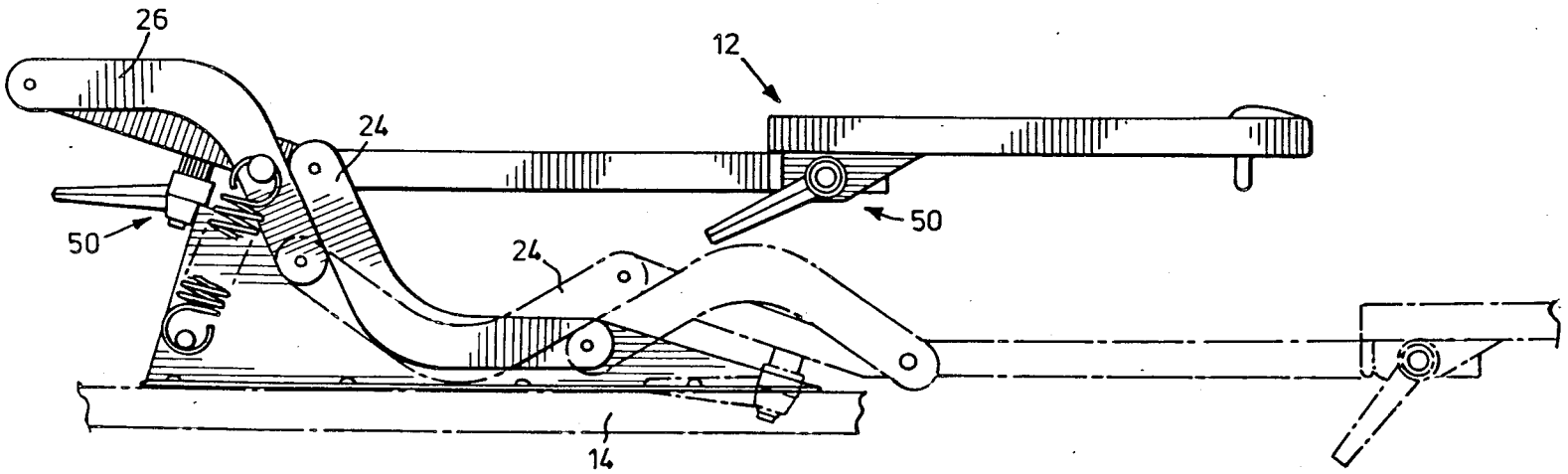
FIG. 7 is a side view of a modified embodiment featuring an inverted linkage for attachment on top of a support system.

While the bi-stable characteristic of the foregoing disclosed embodiments relies upon the springs 79, the inverted arrangement in FIG. 7 likewise remains in either of its extremes of location, under the influence of gravity, due to the interaction of the elbow links 24, 26.

While the illustrated embodiment shows two pairs of elbow links, one pair on each side of the moveable frame portion 28, in order to ensure optimum working stability to the platform 12, it will be understood that a single pair of elbow links can provide the requisite positional displacement of the platform 12.

While but two embodiments of the apparatus have been described and illustrated in the drawings, any modifications thereto may be made by a person skilled in the art while keeping within the spirit of the invention, and the following claims are intended to protect all forms of the invention lying within their ambit.

I claim:

1. A manually repositionable work station apparatus comprising:

a mounting frame;

at least one pair of links of substantially equal effective length with each link having a cranked portion intermediate the ends thereof, said at least one pair of links being pivotally secured in spaced apart relation to said mounting frame and to a movable support frame portion of the apparatus;

a working plateform secured to said moveable support frame so as to provide a predetermined range of displacement of said work station from a fully extended working position to a fully retracted, stowed position, while maintaining the attitude of said working platfrom substantially constant;

spring means connecting one said link intermediate the ends thereof to one said frame, said spring means urging said links to one or other of said positions;

wherein, said cranked portions are arranged in spaced apart back-to-back relation, such that, in said fully extended position, said links are in mutually overlying partly nested contacting relation to position said working platform in a raised condition substantially level with said mounting frame, and, in said fully retracted position, said links are in a reversed mutually overlying partly nested contacting relation, so as to position said working platfrom in predetermined spaced relation beneath said mounting frame, thereby to provide accommodation for a keyboard apparatus for predetermined height in stored relation thereon.

2. The apparatus as set forth in claim 1, including adjustable brake means interconnecting one of said links and one of said frames to selectively and releasably immobilize said one link relative to said frame, thereby to render said working platform substantially immoveable in a position intermediate to said fully extended working position and said retracted, stowed position.

3. The apparatus as set forth in claim 2, comprising two pairs of said links arranged in spaced apart relation on each side of said moveable support frame.

4. The apparatus as set forth in claim 2, said brake means having located within said moveable support frame portion a bifurcated brake block straddling a pivot pin on which a said link is pivotally mounted, a threaded spindle and torque arm for releasably squeezing said brake block in immobilizing relation with aid pivot pin, to selectively lock said link in immobilized relation with said frame.

5. The apparatus as set forth in claim 4, including pivotal attachment means adjustably securing said working platform to said moveably support frame, and adjustable handle means for releasably adjusting the relative inclination of said working platform.

* * * * *